US007441511B2

(12) United States Patent
Farinella et al.

(10) Patent No.: US 7,441,511 B2
(45) Date of Patent: Oct. 28, 2008

(54) WATERCRAFT ARRESTING SYSTEM

(75) Inventors: Michael D. Farinella, Belmont, MA (US); Mads Christian Schmidt, Cambridge, MA (US); Scott Quigley, Abington, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 11/363,231

(22) Filed: Feb. 27, 2006

(65) Prior Publication Data

US 2007/0017432 A1 Jan. 25, 2007

Related U.S. Application Data

(60) Provisional application No. 60/656,979, filed on Feb. 28, 2005.

(51) Int. Cl.
*B63B 17/00* (2006.01)

(52) U.S. Cl. ..... 114/382; 89/1.34; 244/137.1; 244/137.3

(58) Field of Classification Search ..... 441/85, 441/80, 30, 32, 33; 114/241, 240 C, 240 E, 114/382; 405/63, 64, 66–72; 89/1.34; 244/137.3, 244/137.1
See application file for complete search history.

(56) References Cited

U.S. PATENT DOCUMENTS

| | | | | |
|---|---|---|---|---|
| 1,198,035 | A | 9/1916 | Huntington | |
| 1,229,421 | A | 6/1917 | Downs | |
| 1,235,076 | A | 7/1917 | Stanton | |
| 1,275,317 | A * | 8/1918 | Stearns | 102/409 |
| 2,296,980 | A | 9/1942 | Carmichael | |
| 2,308,683 | A | 1/1943 | Forbes | |
| 2,322,624 | A | 6/1943 | Forbes | |
| 3,074,671 | A * | 1/1963 | Dinolfo et al. | 244/138 R |
| 3,703,084 | A * | 11/1972 | Nugent | 405/72 |
| 3,986,159 | A * | 10/1976 | Horn | 367/4 |
| 4,534,675 | A * | 8/1985 | Morrisroe | 405/24 |
| 4,768,417 | A | 9/1988 | Wright | |
| 5,069,109 | A | 12/1991 | Lavan, Jr. | |
| 5,524,524 | A | 6/1996 | Richards et al. | |
| 5,578,784 | A | 11/1996 | Karr et al. | |
| 5,583,311 | A | 12/1996 | Rieger | |
| 5,675,104 | A | 10/1997 | Schorr et al. | |
| 5,750,918 | A | 5/1998 | Mangolds et al. | |
| 6,029,558 | A | 2/2000 | Stevens et al. | |
| 6,279,449 | B1 | 8/2001 | Ladika et al. | |
| 6,325,015 | B1 | 12/2001 | Garcia et al. | |
| 6,374,565 | B1 | 4/2002 | Warren | |
| 2001/0032577 | A1 * | 10/2001 | Swartout et al. | 114/254 |
| 2004/0038604 | A1 * | 2/2004 | Safwat et al. | 442/1 |
| 2005/0016372 | A1 * | 1/2005 | Kilvert | 89/1.34 |

FOREIGN PATENT DOCUMENTS

| | | |
|---|---|---|
| DE | 2206404 | 8/1973 |
| DE | 3722420 | 1/1989 |

(Continued)

*Primary Examiner*—Sherman Basinger
(74) *Attorney, Agent, or Firm*—Iandiorio Teska & Coleman

(57) ABSTRACT

A watercraft arresting system and method including an entanglement subsystem including at least two arms in a V-configuration. A deployment subsystem deploys the entanglement subsystem so the arms are spread apart in the water in the path of the watercraft to arrest it.

27 Claims, 14 Drawing Sheets

FOREIGN PATENT DOCUMENTS

| | | |
|---|---|---|
| DE | 3735426 | 5/1989 |
| DE | 3834367 | 4/1990 |
| DE | 4437412 | 9/1995 |
| EP | 0655603 | 5/1995 |
| EP | 0872705 | 4/1998 |
| EP | 0902250 | 9/1998 |
| FR | 2695467 | 3/1994 |
| WO | WO 99/30966 | 6/1999 |

* cited by examiner

WATERCRAFT ARRESTING SYSTEM

RELATED APPLICATIONS

This application claims benefit of U.S. Provisional Application No. 60/656,979, filed Feb. 28, 2005, entitled "Boat Trap Air Delivery System".

FIELD OF THE INVENTION

This subject invention relates to systems and methods for arresting watercraft including, but not limited to, an entanglement system deployed in the path of the watercraft to slow it down or stop it typically as the entanglement system becomes trapped in the propeller of the Watercraft.

BACKGROUND OF THE INVENTION

There is often a need to arrest or slow a vessel in the water. One example includes a suspected contraband carrying vessel pursued by the coast guard or police. Another example includes watercraft suspected of acts of terrorism. Pirate ships, out of control pleasure watercraft, illegal fishing vessels, and vessels in or about to enter restricted areas are just a few of the many other examples where a watercraft arresting systems would be useful.

U.S. Pat. No. 6,325,015, incorporated herein by this reference, discloses that attempts to use propeller entanglement lines as a water craft arresting mechanism have failed and proposes instead a net deployed by rockets to snare the watercraft itself. Drag devices attached to the net are intended to slow the vessel once the net covers the vessel.

For bigger vessels, such a net would have to be extremely large. Moreover, the notion of using rockets to deploy the net renders the system complex, difficult to use and expensive.

U.S. Pat. No. 4,768,417, also incorporated herein by this reference, discloses a net with detonator chord launched into the path of a vessel to damage the watercraft. U.S. Pat. No. 5,069,109, also incorporated herein by this reference, discloses a net deployed in a path of a munition such as a torpedo to entangle it. How such as a net is deployed is not described in detail.

The inventors hereof have discovered that a net in a single panel configuration is difficult to deploy accurately and quickly, does not typically stay in the expanded configuration once in the water, and does not reliably arrest watercraft.

SUMMARY OF THE INVENTION

It is therefore an object of this invention to provide a watercraft arresting system which is simple in design.

It is a further object of this invention to provide such an arresting system which is easy to use.

It is a further object of this invention to provide such a system which is relatively inexpensive when compared to prior arresting systems.

It is a further object of this invention to provide such an arresting system which is able to arrest water craft of all sizes and configurations.

The subject invention results from the realization that instead of attempting to snare watercraft with a single panel net configuration which is difficult to deploy accurately and difficult to maintain in an expanded configuration in the water, a more reliable system relies on an entanglement system with arms in a V-configuration deployed so the arms spread out in the water in the path of the watercraft to arrest it.

This subject invention features a watercraft arresting system comprising an entanglement subsystem including at least two arms in a V-configuration and a deployment subsystem for deploying the entanglement subsystem so the arms are spread apart in the water in the path of the watercraft.

In one example, the entanglement subsystem includes two additional arms also in a V-configuration forming an X-configuration with the first two arms. In other examples, the entanglement subsystem includes three arms in a Y-configuration, multiple arms in a star-configuration, or a third arm connected to the first two arms in a triangle configuration. The arms can be made of netting, sheet material, or a rope material.

In the preferred embodiment, the entanglement subsystem includes at least four arms made of SPECTRA net material in a knotless weave. Each arm is typically connected to a head line, and a perimeter line connected to ends of the head lines. Preferably, the netting material for each arm is longer than an arm, bunched up, and slideably attached to a head line. The head lines are typically slideably attached to the perimeter line and each arm may be connected to a foot line opposite the head line. The foot lines may be weighted. A variation of this would have the head lines fixed to points on the perimeter line.

The preferred deployment subsystem includes a carrier for the arms, a parachute attached to the carrier, and a discharge assembly attached to the carrier for spreading the arms. Typically, the carrier, parachute, and the discharge assembly are packaged in a launch tube. Preferably, there are means for releasing the carrier, the parachute, and the discharge assembly from the launch tube; means for deploying the parachute; and means for activating the discharge assembly after the parachute is deployed. In one example, there is a plug attached to each arm and the discharge assembly includes the barrel for each plug. Adjacent barrels may be at an angle of 90° with respect to each other. The preferred means for activating the discharge assembly includes a fuse assembly for firing the charges and a firing pin for igniting the fuse assembly. In one embodiment, the fuse assembly includes a primer charge set off by the firing pin, a delay fuse lit by the primer charge, and fuse links each extending between the delay fuse and a plug charge and lit by the delay fuse. In this particular embodiment, the means for releasing the carrier includes a launch tube top plate including at least one clamp releasably holding the carrier in the launch tube. The means for deploying the parachute then includes a tether extending between the top plate and the parachute and the means for activating the discharge assembly includes a tether line which pulls the firing pin. Typically, the tether line which pulls the firing pin is shorter than the tether extending between the top plate and the parachute. A safety interrupt between the firing pin and the fuse assembly may be included as well as a safety pin releasably locking the carrier in the launch tube.

In one preferred embodiment, the watercraft arresting system includes an entanglement subsystem including at least two arms in a V-configuration and a deployment subsystem for deploying the entanglement subsystem so the arms are spread apart in the water in the path of the watercraft. The deployment subsystem includes a launch tube housing, a carrier for the arms, a parachute attached to the carrier, and a discharge assembly for spreading the arms. The preferred deployment subsystem further includes means for releasing the carrier, the parachute, and the discharge assembly from the launch tube, means for deploying the parachute, and means for activating the discharge assembly after the parachute is deployed.

One method of arresting a watercraft vessel in accordance with the subject invention features packaging an entanglement subsystem on a carrier attached to a parachute and a deployment subsystem all in a launch tube. The carrier, the parachute, and the deployment subsystem are released from the launch tube. The parachute is deployed and the deployment subsystem activated to deploy the entanglement subsystem in the water in the path of the vessel.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
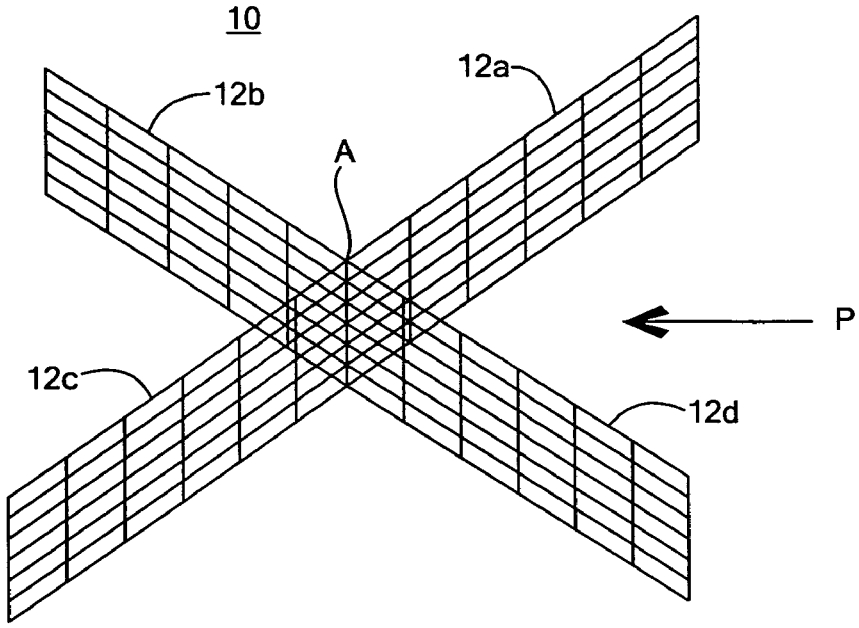
FIG. 1 is a schematic three-dimensional highly conceptual view of one example of an arresting subsystem in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As delineated in the Background section above, a net with a single panel is difficult to deploy and difficult to maintain in a spread out configuration once in the water. In the subject invention, entanglement subsystem 10, FIG. 1 includes multiple arms 12*a*-12*d* as shown spread apart in a V-configuration in the path P of a watercraft to be arrested. This configuration renders the orientation of arms 12*a*-12*d* in the water irrelevant because the watercraft will always strike either an arm or the apex A of the entanglement subsystem and then the other arms will then wrap around the vessel in response and ensnare the propeller and/or slow the watercraft. Indeed, it is not necessary that arms 12*a*-12*d* extend vertically down into the water as show in FIG. 1 or that arms 12*a*-12*d* be made of netting. Arms 12*a*-12*d* could be made of sheet material or ropes, for example.

Figure 2:
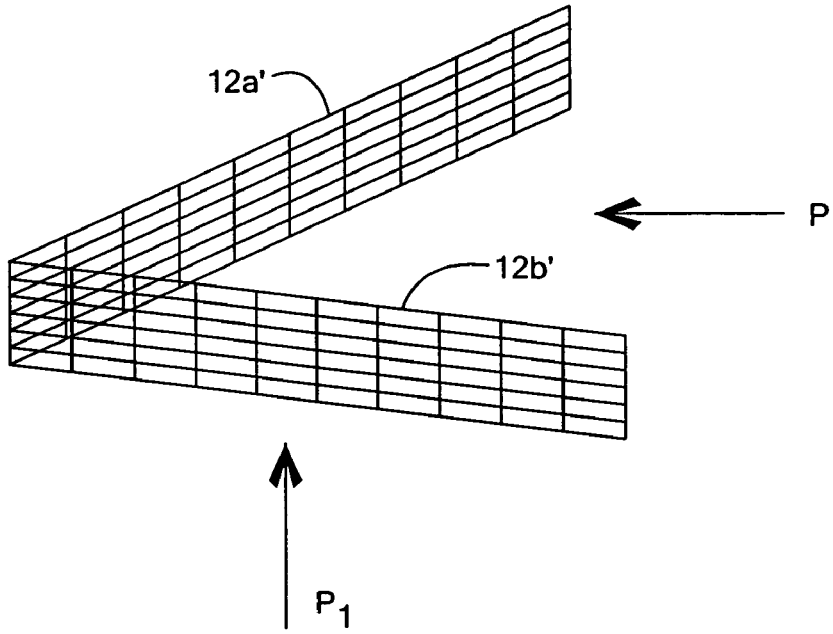
FIG. 2 is a schematic three-dimensional conceptual view of another embodiment of an entanglement subsystem in accordance with the subject invention.

The X-configuration configuration shown in FIG. 1 is also not a necessary limitation of the subject invention. FIG. 2 shows arms 12*a*'-12*b*' in a V-configuration in the path P of a vessel but if a watercraft is instead heading along path $P_1$, it will strike arm 12*b*' and arm 12*a*' will swing around and snare the propeller and/or slow the watercraft.

Figure 4:
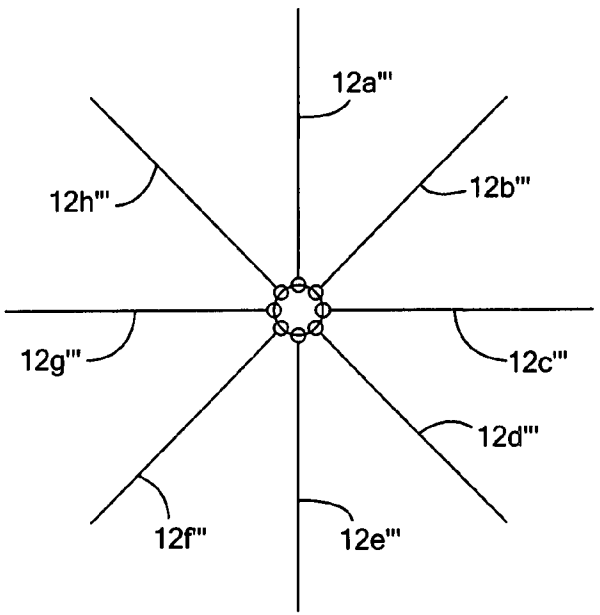
FIG. 4 is a schematic top view showing still another possible version of an entanglement subsystem in accordance with the subject invention.
Figure 3:
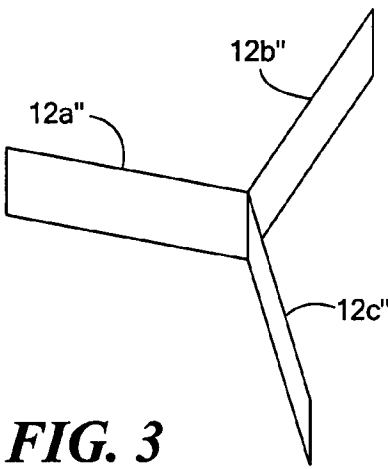
FIG. 3 is a three-dimensional schematic top view of another possible configuration of an entanglement subsystem in accordance with the subject invention.
Figure 5:
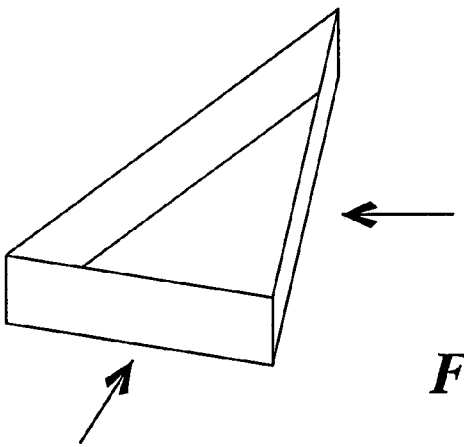
FIG. 5 is a schematic three-dimensional view showing conceptually another embodiment of an entanglement subsystem in accordance with the subject invention.

FIG. 3 shows another possibility with sheet-like arms 12*a*"-12*c*" in a Y-configuration; FIG. 4 shows another possible version where rope or cable arms 12*a*'"-12*h*'" form a star configuration, and FIG. 5 shows net arms $\mathbf{12}a^{IV}$-$\mathbf{12}c^{IV}$ in a triangle configuration. Other configurations are possible and within the scope of the subject invention.

Figure 6:
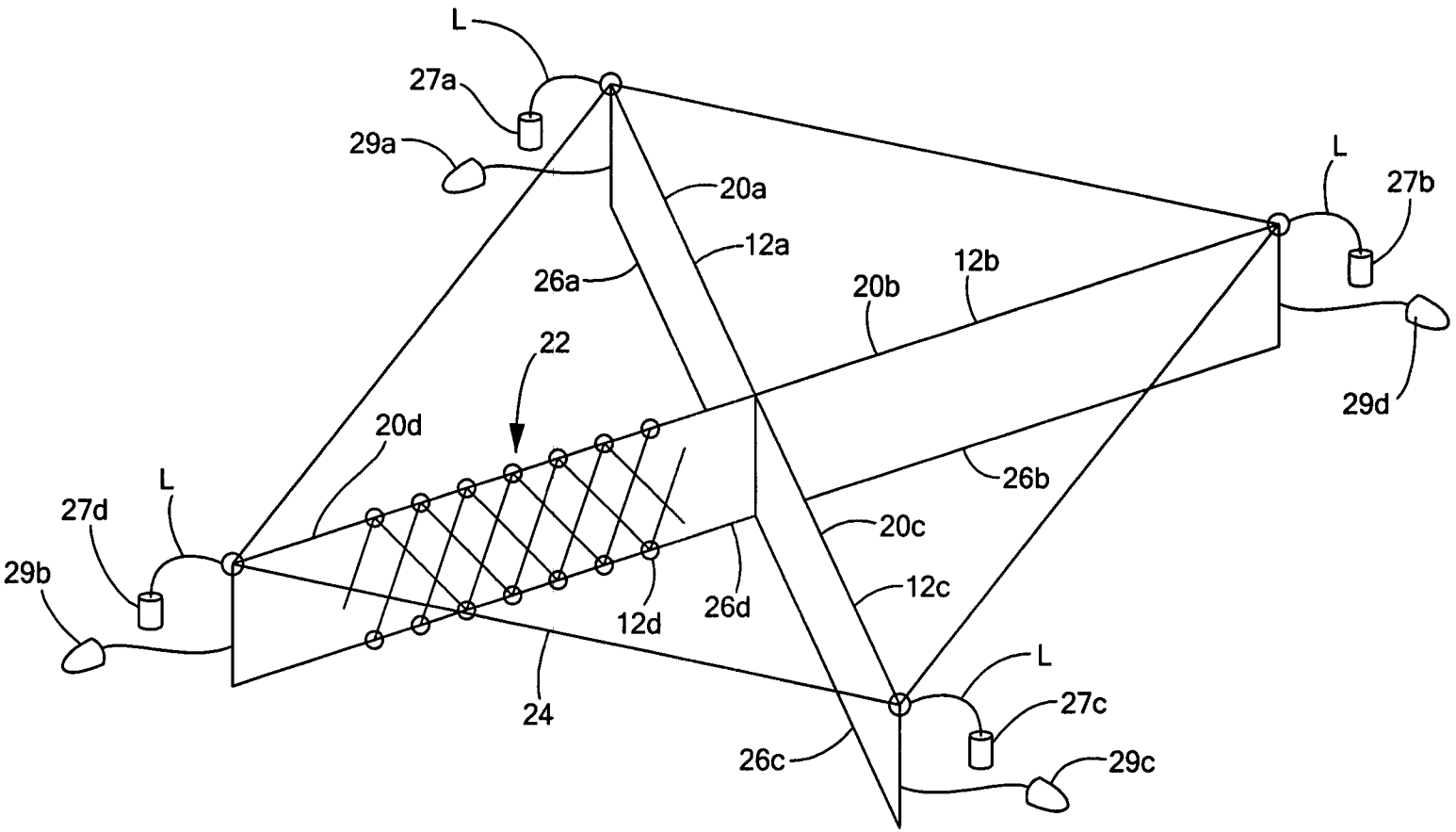
FIG. 6 is a schematic three-dimensional conceptual view of one preferred embodiment of an entanglement subsystem in accordance with the subject invention.

In one preferred embodiment, entanglement subsystem 10', FIG. 6 includes net arms 12*a*-12*d* similar to FIG. 1, each 50 feet long, 6 feet tall, made of 3-inch knotless mesh SPECTRA material. The net material of each arm is 125 feet in length and bunched along head lines 20*a*-20*d* and, as shown at 22, slideably attached to its respective head line. This feature increases the amount of net material that can entangle the target vessel propeller. ⅜ inch SPECTRA perimeter line 24 is slideably attached to the ends of each head line 20*a*-20*d* to draw the ends of each arm towards the target vessel as it passes through the device. Foot lines 26*a-d* may be weighted or not depending on the specific implementation. Drogue chutes 29*a-d* can be attached to the ends of each net arm or to the perimeter line to create drag once the system is deployed to slow the vessel. In another embodiment, perimeter line 24 forms a circle. In still another embodiment, additional net arms and head lines are present and connected to a round or square perimeter line.

Figure 7:
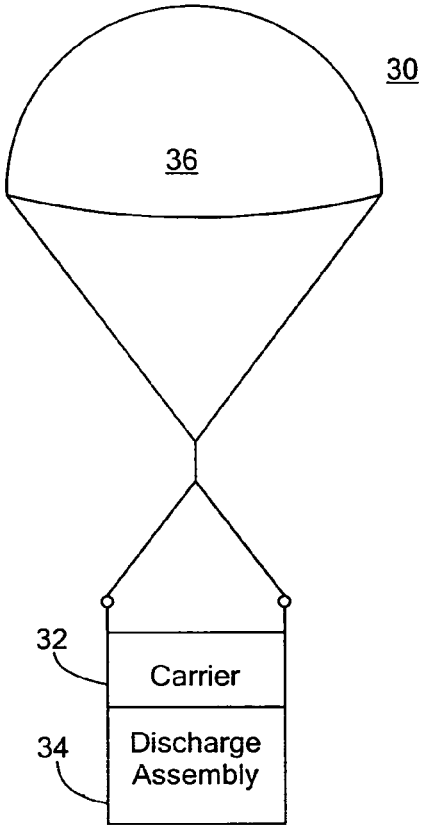
FIG. 7 is a schematic block diagram showing one embodiment of a preferred watercraft arresting system in accordance with the subject inventions.

The subject invention also includes a deployment subsystems for deploying the entanglement device so the arms thereof are spread apart in the water in the path of the watercraft. Although the deployment subsystem can take many forms, in one particular embodiment, deployment subsystem 30, FIG. 7 includes carrier 32 housing the entanglement arms packaged therein or thereon, a discharge assembly 34 for spreading the arms into the configuration shown in FIGS. 1-6 (depending on the specific embodiment of the arms), and preferably a parachute 36 attached to carrier 32. Typically, this system is dropped from a helicopter or other aircraft.

Parachute 36 is deployed first, and then discharge assembly 34 deploys the entanglement device when the system is closer to the surface of the water and in the path of a vessel to be arrested. This helps to maintain an element of surprise.

Figure 8:
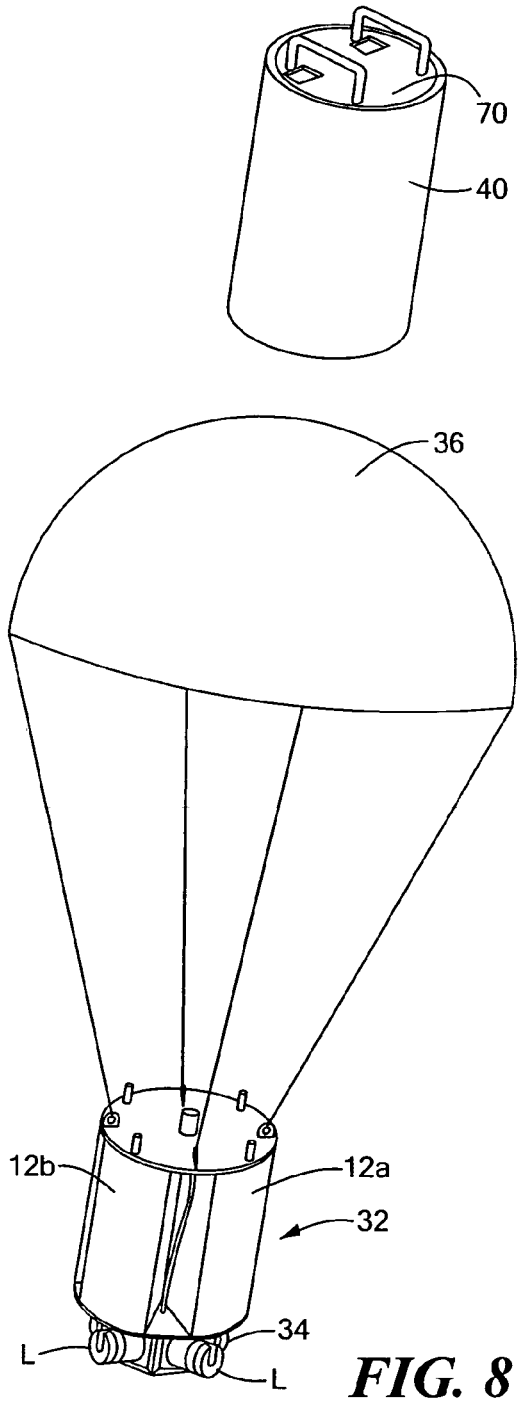
FIG. 8 is a schematic three-dimensional view showing the primary components associated with a preferred watercraft arresting system in accordance with the subject inventions.
Figure 9:
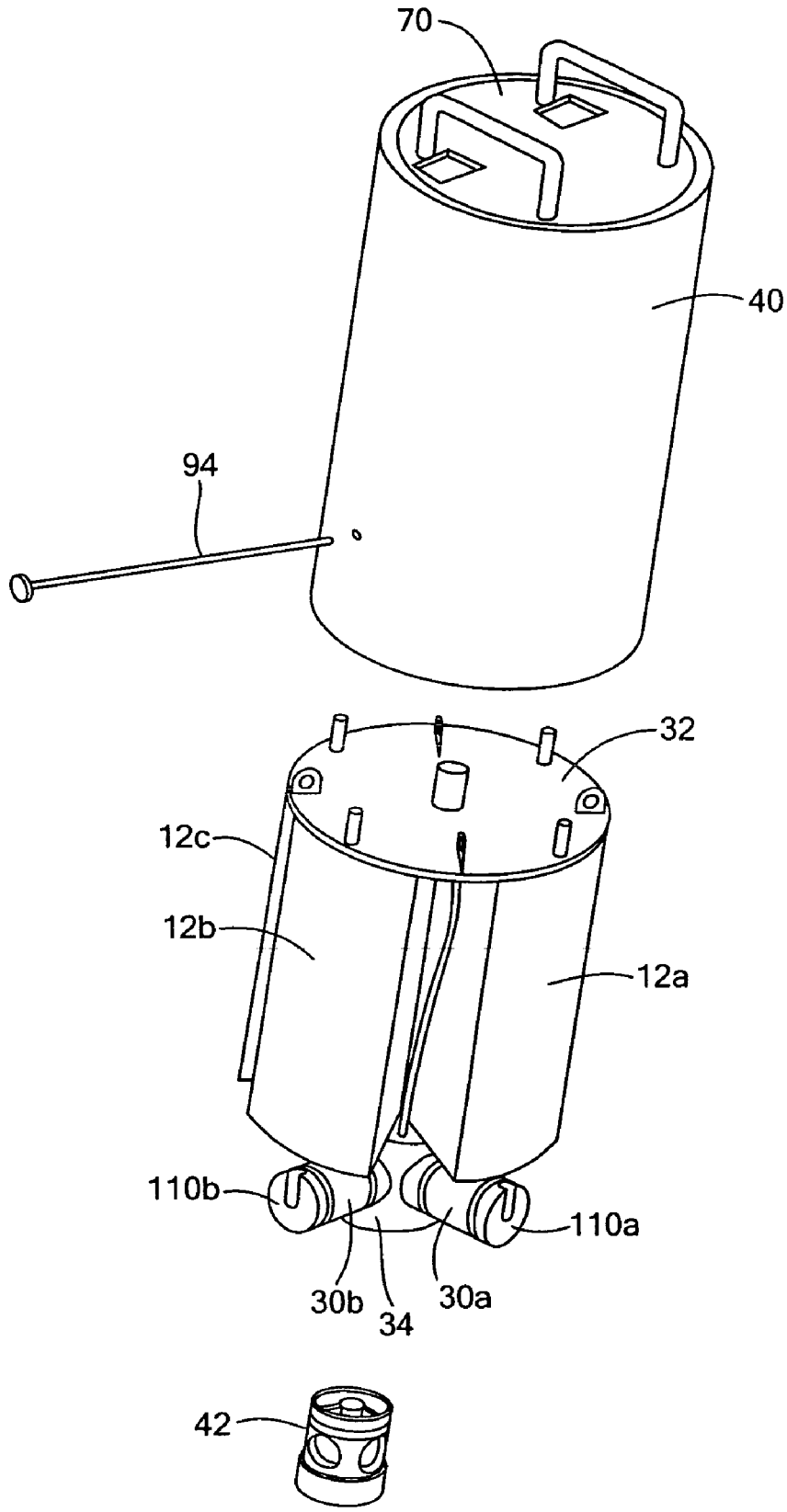
FIG. 9 is a schematic three-dimensional exploded view showing in more detail the components of the watercraft arresting system shown in FIG. 8.
Figure 10:
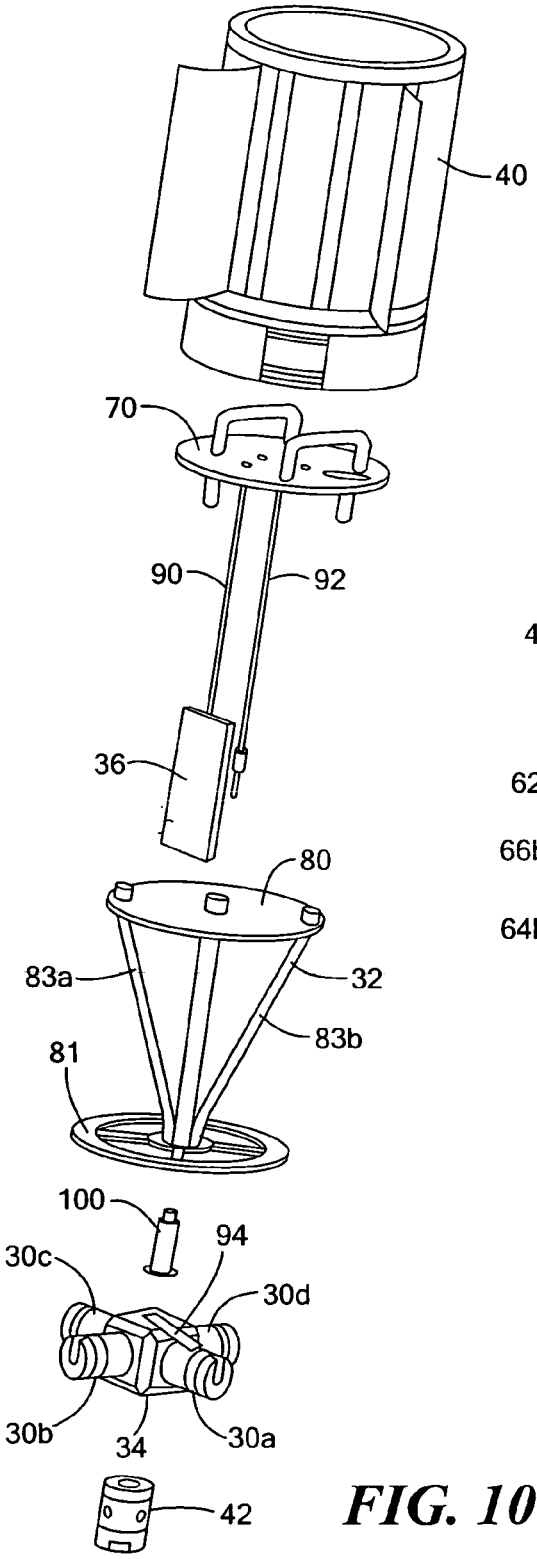
FIG. 10 is a schematic three-dimensional exploded view again showing the primary components associated with the watercraft arresting system of FIG. 8.
Figure 11:
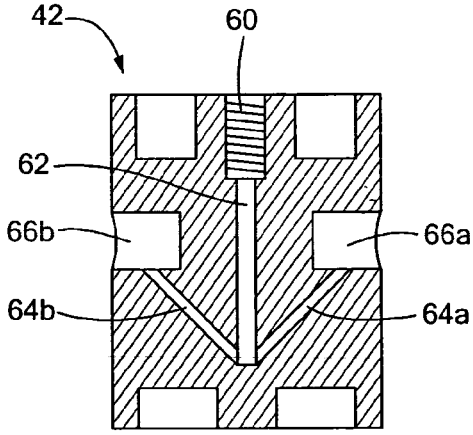
FIGS. 11 is a schematic cross-sectional side view of an example of a fuse assembly associated with the watercraft arresting system shown in FIGS. 8-10.

For the example shown in FIG. 6, one specific deployment system includes carrier 32, FIGS. 8-10, discharge assembly 34, and parachute 36 all initially and releasably housed in launch tube 40. A deployment weight plug 27*a*-27*d*, FIG. 6, is attached to each net arm end and placed in a respective barrel or deployment tube 30*a*, 30*b*, and the like, FIGS. 8-10 of discharge assembly 34. There is a charge in each barrel behind each plug. As shown in FIGS. 8-10, for the net configuration of FIG. 6, adjacent barrels are at an angle of 90° with respect to each other. Fuse assembly 42, FIGS. 9-11 is removably inserted into discharge assembly 34 and is configured to fire the charges in each barrel of discharge assembly 34 when initiated by firing pin 50, FIG. 12. In one example, fuse assembly 42, FIG. 11 includes primer charge 60 set off by firing pin 50, FIG. 12, 2.5 second delay fuse 62, FIG. 11 lit by primer charge 60, and fuse links 64*a*, 64*b* and the like one each extending between delay fuse 62 and each plug charge 66*a*, 66*b*, and the like—one behind each plug in the launch barrel.

Launch tube 40 top plate 70, FIGS. 8-10 includes clamps 72*a* and 72*b* which releasably hold top plate 80, FIG. 10 of carrier 32 in launch tube 40. Clamps 72*a* and 72*b* are released by latch 82, FIG. 12 once safety pin 84 is removed.

Figure 12:
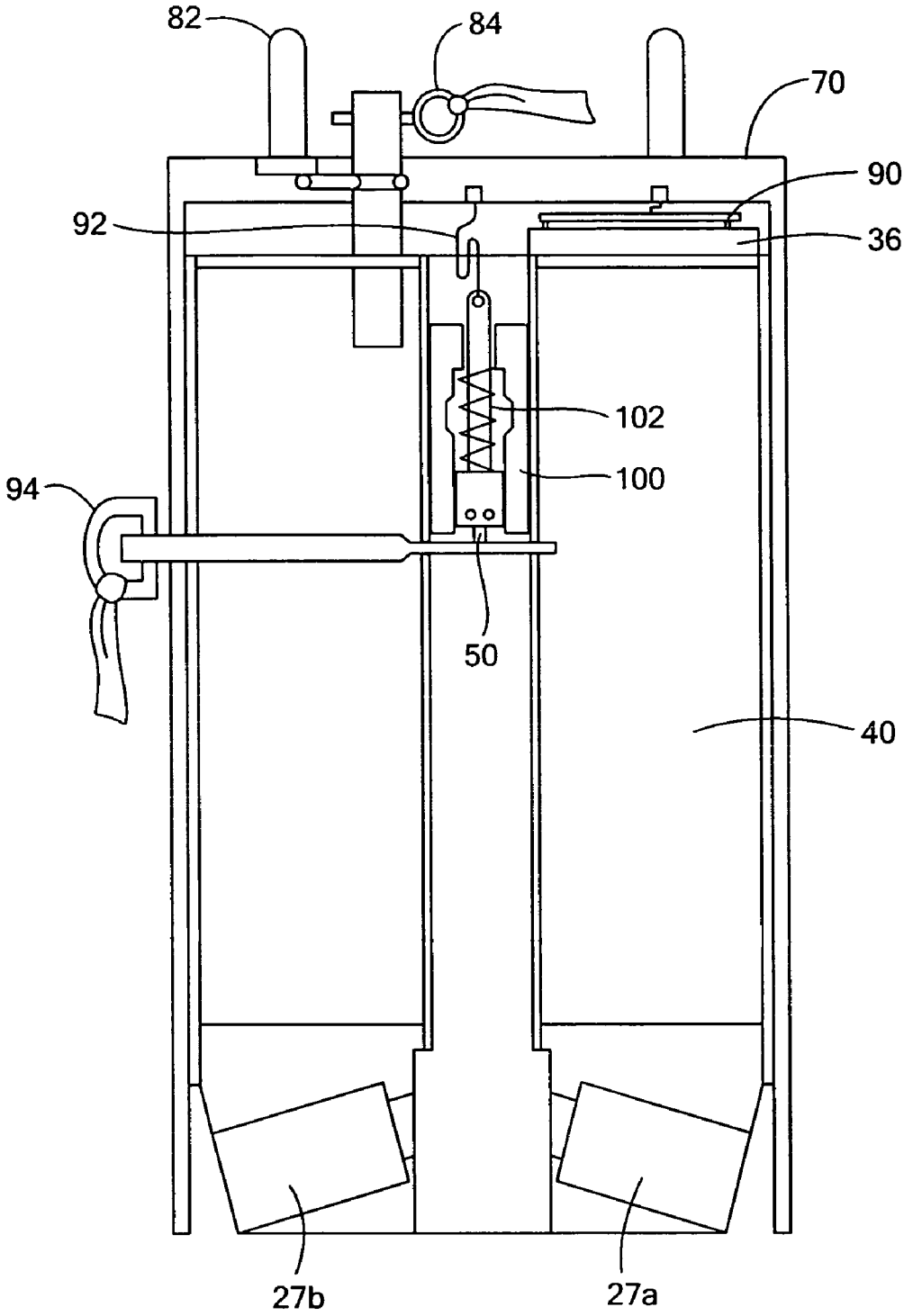
FIG. 12 is a schematic cross-sectional view showing the primary components associated with the watercraft arresting system shown in FIGS. 8-10.
Figure 13:
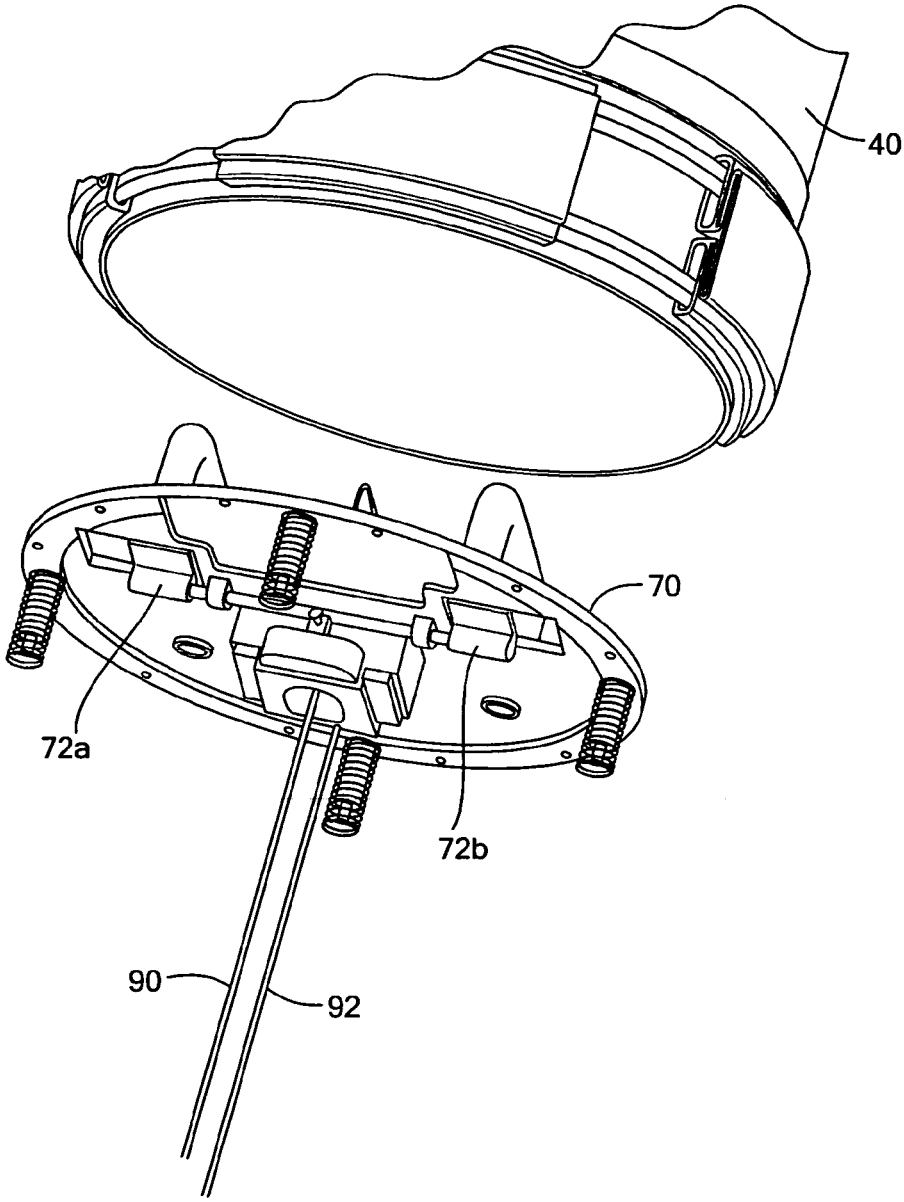
FIG. 13 is a schematic three-dimensional exploded view showing the top plate of the launch tube associated with the watercraft arresting system shown in FIGS. 8-10 and 12.

Tether 90, FIGS. 10 and 12-13 extends between launch tube top plate 70 and parachute 36 to deploy parachute 36 once carrier 32 and discharge assembly 34 clears launch tube 40 after clamps 72*a* and 72*b*, FIG. 13 are released. At the same time, provided safety interrupt 94, FIGS. 9 and 12 has been withdrawn, tether line 92, FIGS. 10, 12, and 13 pulls firing pin 50 up into housing 100, FIG. 12 compressing spring 102. As compression spring 102 reaches its compressed state, firing pin 50 will be released via a ball and detent system within housing 100. The compression spring will then force the firing pin 50 down the bore of housing 100, at which point firing pin 50 will come into contact with the deployment initiator 60, which will begin the deployment sequence.

Figure 14:
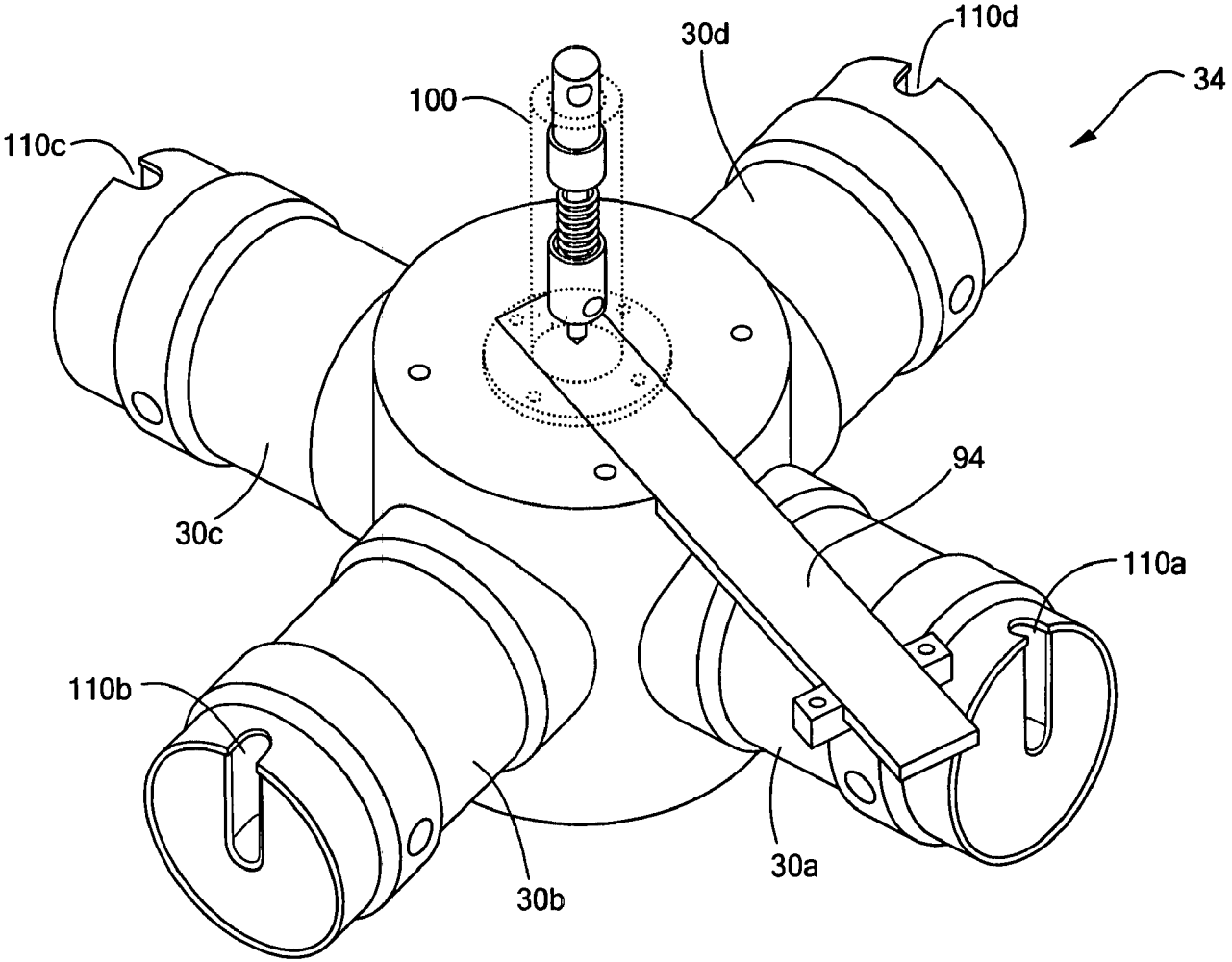
FIG. 14 is a schematic three-dimensional view showing an example of a discharge assembly with the safety interrupt in place.
Figure 15:
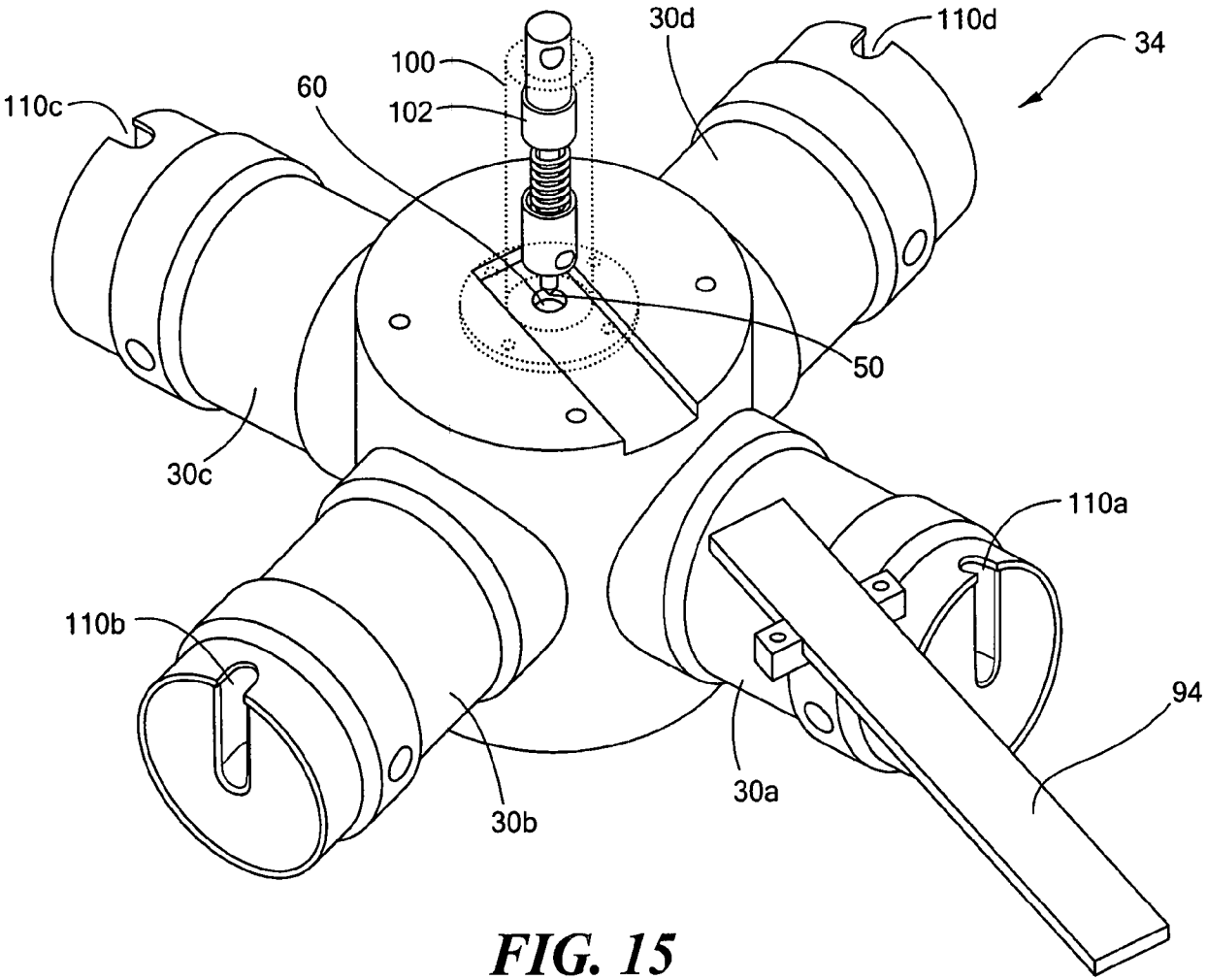
FIG. 15 is a schematic three-dimensional view of the deployment system shown in FIG. 14 but now the safety interrupt has been released.

See also FIGS. 14-15 which show firing pin housing 100 in phantom, firing pin 50, spring 102, and the relation between those components to primer charge 60 in discharge assembly 34. As shown in FIGS. 8-9, discharge assembly 34 with fuse assembly 42, FIG. 9 inserted therein is attached to carrier 32 which includes top plate 80, FIG. 10, bottom plate 81, and frame members 83*a*, 83*b* and the like defining triangular shaped housing for each arm of the net. Barrels 30*a*-30*d* of discharge assembly 34 have notches 110*a*-110*b* for receiving the lines L, FIG. 6 and 8 which attach the plugs 27*a*-27*d* to the respective net arms.

Figure 16B:
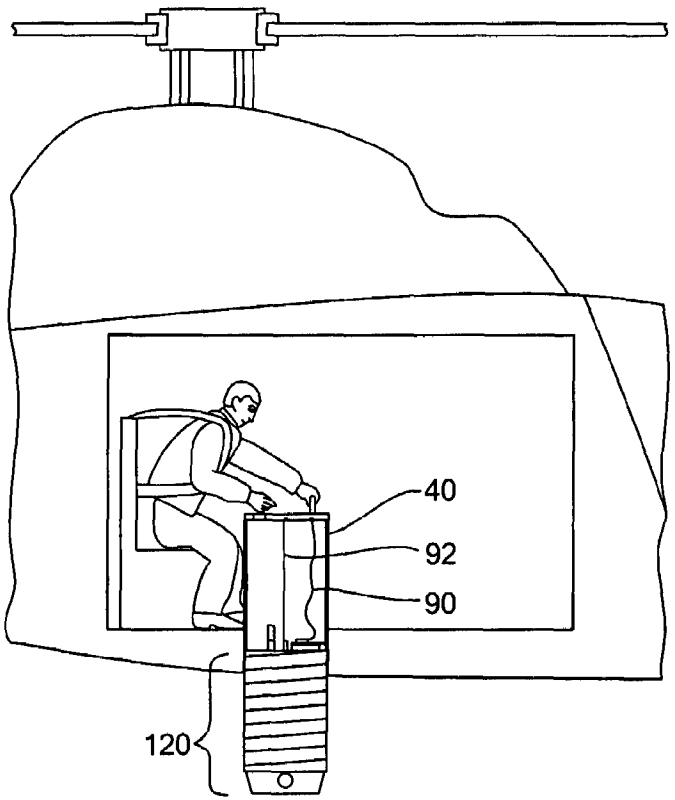
FIGS. 16A-16E are schematic three-dimensional conceptual views showing how the watercraft arresting system of the subject invention shown in the previous figures is deployed.
Figure 16A:
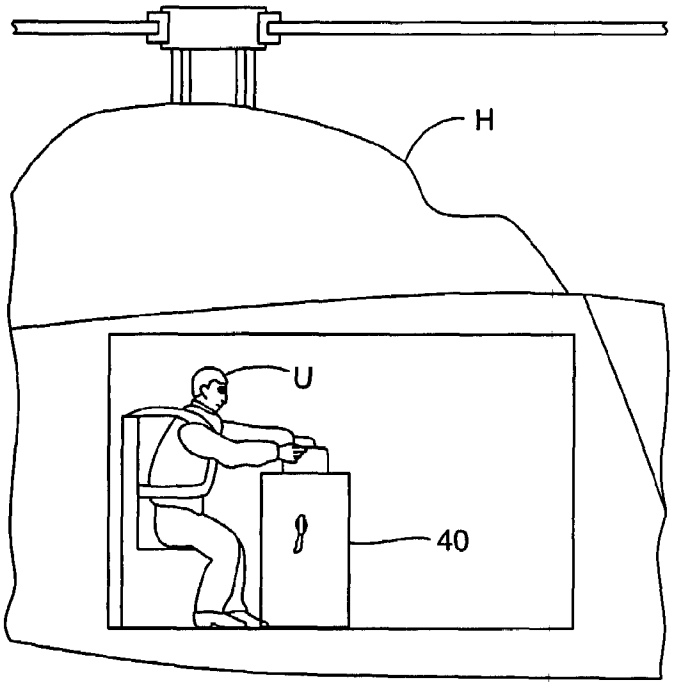
Figure 16C:
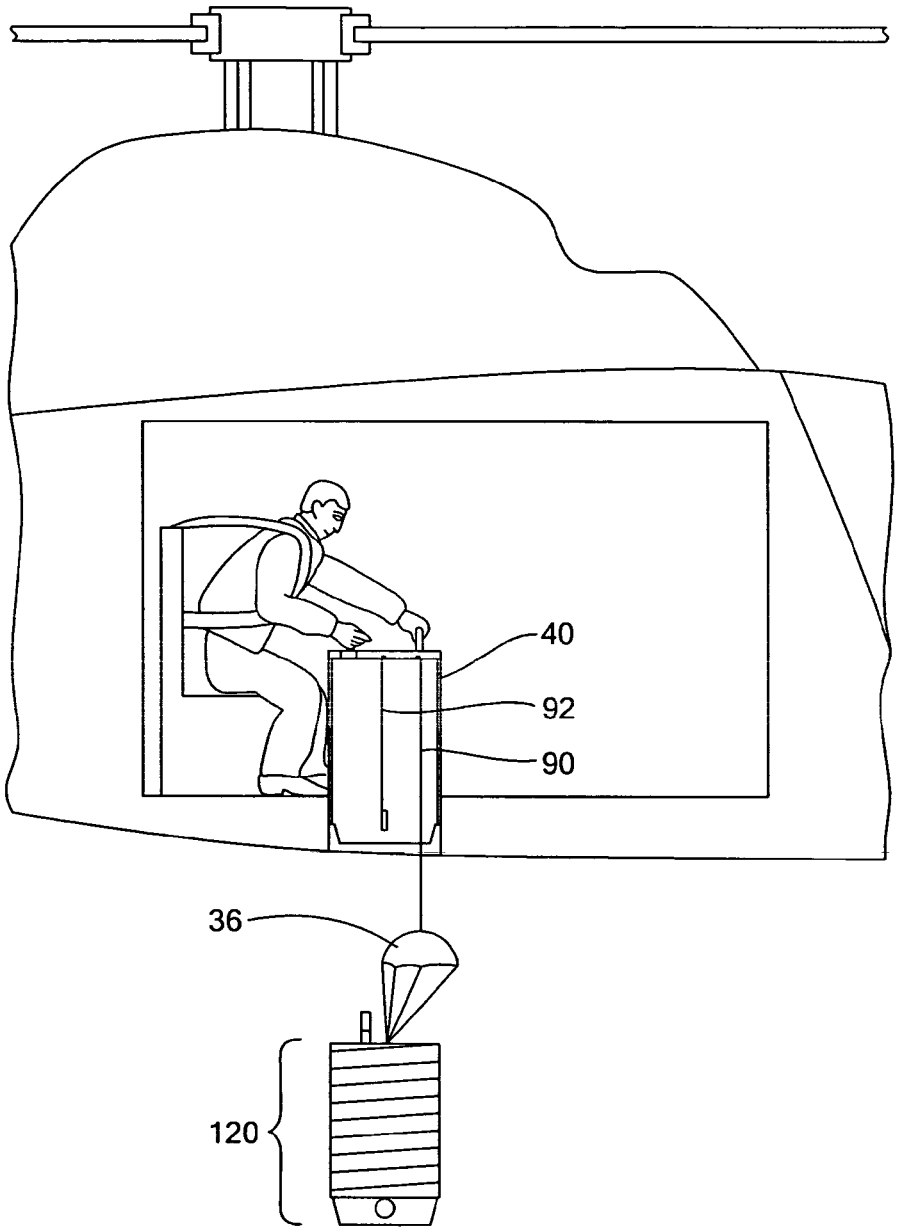

During deployment, FIG. 16A, the user U in helicopter H removes safety interrupt 94, FIG. 12 and safety pin 84, and then releases latch 82 when the helicopter is approximately 100 feet above the surface of the water. The net carrier and the discharge assembly combination as shown at 120, FIG. 16B then slides out of launch tube 40 and parachute tether 90 and firing pin tether 92 begin to unfurl. As the munition separates from launcher tube 40, firing pin tether 92, being shorter than parachute tether 90, causes the firing pin 50, FIG. 12 to strike primer 60, FIG. 15 before parachute tether 90, FIG. 16, deploys parachute 36. Delay fuse 62, FIG. 11 now bums while the munition drops downward, FIG. 16D until fuse links 64*a*, 64*b*, and the like, FIG. 11 are lit and plug charges 66*a*, 66*b*, and the like detonate, FIG. 16E to deploy the net arm plugs 27 out of their respective barrels 30 preferably at a height of approximately 50 feet above the surface of water W.

Safety of the user U and helicopter H is insured due to the separation of the munition from helicopter H before net deployment and the use of mechanical and pyrotechnic fusing instead of electrical fusing The length of the tethers ensures that the unit will be clear of the launch tube before the spreader sequence begins. In order to address the safety, retrieval and environmental concerns of the unit, a highly visible floatation system can be attached to the spreader unit. This allows for easy retrieval of the system.

The result is the ability to arrest vessels with limited risk to the vessel itself or its occupants. The entangling device is fairly simple to deploy and position in a timely manner so as to preclude a target vessel from taking evasive action. The deployment subsystem and the package entanglement subsystem are packaged small and are light enough to be carried aboard a helicopter and capable of being deployed while in pursuit of a vessel. The omni directional entanglement net is deployed prior to water impact placing it directly in the path of the target vessel and the fast acting deployment (approximately one second) acts as an element of surprise to the vessel operator giving the pursuing authority at distinct tactical advantage. The fusing system use is simple and fail safe insuring that during all aspects of an operation including ground handling and storage there can be no harm to the user and, at the same time, the fusing system is highly effective. Because the entire fusing subsystem is non-electrical, electrical, magnetic, and radio frequency interference concerns are reduced. The inventors have also demonstrated the efficiency of the launch tube fuse concept disclosed herein from an airborne helicopter environment. Prior to helicopter testing, three tower tests demonstrations were executed and the packages dropped from a 100 to 110 foot crane to stimulate hovering aircraft deployment. In all cases, the system of the subject invention deployed fully and settled to the ground in the proper shape without tangling.

In its packaged configuration, the entanglement subsystem was 22 inches in length, 13 inches in diameter, and weighed 30 pounds. The design of the deployment system allows for shipping the components in two separate containers. The first container holds the primary package within the launch tube without pyrotechnics. The second container holds the delay fuse/pyrotechnics module 42 shown in FIGS. 9-11. For operation, the two components must be assembled prior to deployment from the aircraft, a procedure that requires approximately ten seconds. The package is stored inside a launch tube that has handles to facilitate maneuvering in the aircraft cabin. The package is positively retained in the launch tube by two independent mechanical stops: a safety pin that secures the release latch and a physical interrupt pin that acts as both a positive mechanical retainer and a break in the pyrotechnic chain.

Once the crew locates a target vessel, the operator removes the package from its storage rack and prepares the munition for deployment by inserting the charge block, removing the safety pin and physical interrupt, holding the munition by the launch tube handles, and placing the open end out the cabin door. After the pilot maneuvers into position, the operator actuates the release latch to initiate deployment. As the munition exits the launch tube, a short tether line pulls the firing pin that initiates the delay element within the pyrotechnic train. Once the munition is clear of the launch tube and aircraft, gravity and inertia cause a second, slightly longer tether to pull a bag and deploy the parachute. The tether lengths ensure a clean deployment before any initiation. The package falls for a predetermined time (nominally two seconds) to ensure safe separation from the aircraft and to facilitate near-vertical orientation. When the delay element reaches completion, the pyrotechnic charge detonates and deploys the four deployment plugs each connected to a respective net panel. The deployment plugs, in turn, extract the net.

Delay fuse 62, FIG. 11 and fuse links 64 are composed of silicon-red lead (80% red lead, 20% silicon) with a nitrocellulose or FK-800 binder and diatomaceous earth (DE) as a diluting agent. This compound is a proven GOTS material used for cluster munitions ordnance. The delay time is designed such that a minimum separation distance, or distance from the package to the aircraft at net deployment is achieved 100% of the time. Once the delay composition has burned completely, the spreader output charge(s) are initiated, pressure builds, and the deployment plugs are expelled.

Currently, the notional safe separation requirement is 50 ft, the length of a single net panel. The correlation of this distance to time show that a 50-foot vertical drop is realized in 2.3 seconds using a 5' parachute configuration. With a 3' chute, a vertical drop of 50' is realized in significantly less time than 2.3 seconds (approximately 2.0 seconds). The final safe separation distance requirement was approved by the Aircraft Configuration Control Board (ACCB).

Resulting safe separation achieved at 60 knots delivery was estimated at 100' from the aircraft using video data and the helicopter as a scale reference. The 100' separation is significant margin greater than the 50' safe separation distance approved. The safe separation results were validated during an evasive test series. Twelve drops were executed (9 live) during the evasive test series, the separation ballistics and fuse timing proved to be consistent.

To prevent premature detonation, two safety mechanisms, which require two independent actions, along with a release latch, are designed within the delivery systems. The first mechanism is the physical interrupt 94, FIG. 12 which is positioned between the firing pin and the primer. With the physical interrupt in place, the package cannot be released from the launch tube and the firing pin is isolated from the primer. The second pin 84 is placed through the locator/release pin, providing a second mechanical lock to retain the package in the launch tube.

If the operator mistakenly attempts to trigger the release latch with either of the pins in place, the munition would be mechanically captured within the launch tube and incapable of arming itself.

Once the system is armed (by removing both pins) and releases from the launch tube, the entire process is irreversible. At release, the contents fall away due to gravity and a firing pin ignites the delay composition, the delay composition bums and cannot be stopped. If the parachute tether should hang, the operator will simply release the launch tube and allow the entire system to fall clear of the aircraft, permitting safe separation from the aircraft prior to net deployment. The need to jettison the unit is lessened due to the fact that the unit must clear the launch tube before the tethers reach their ends and initiate the spreader sequence.

Figure 16D:
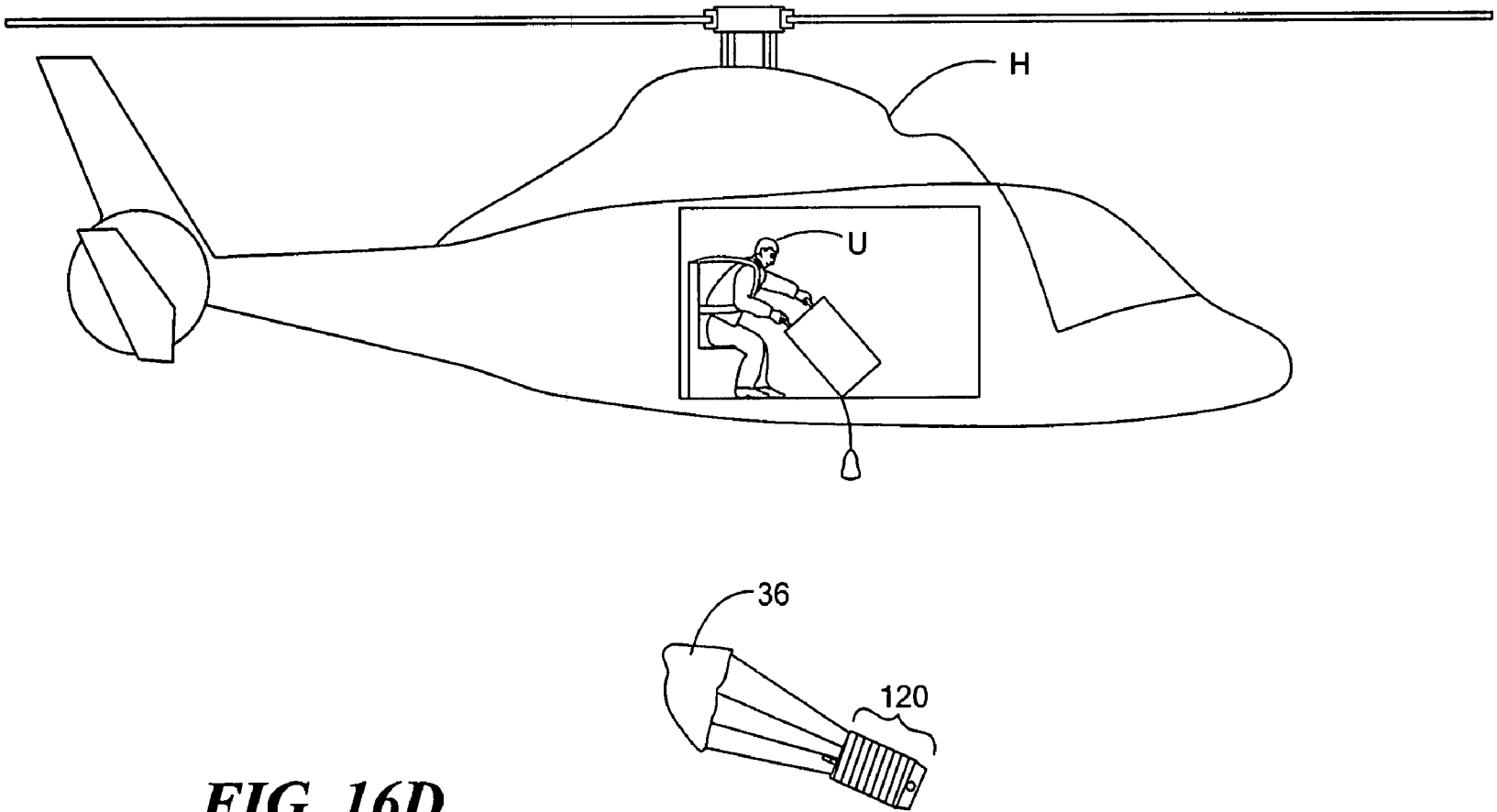
Figure 16E:
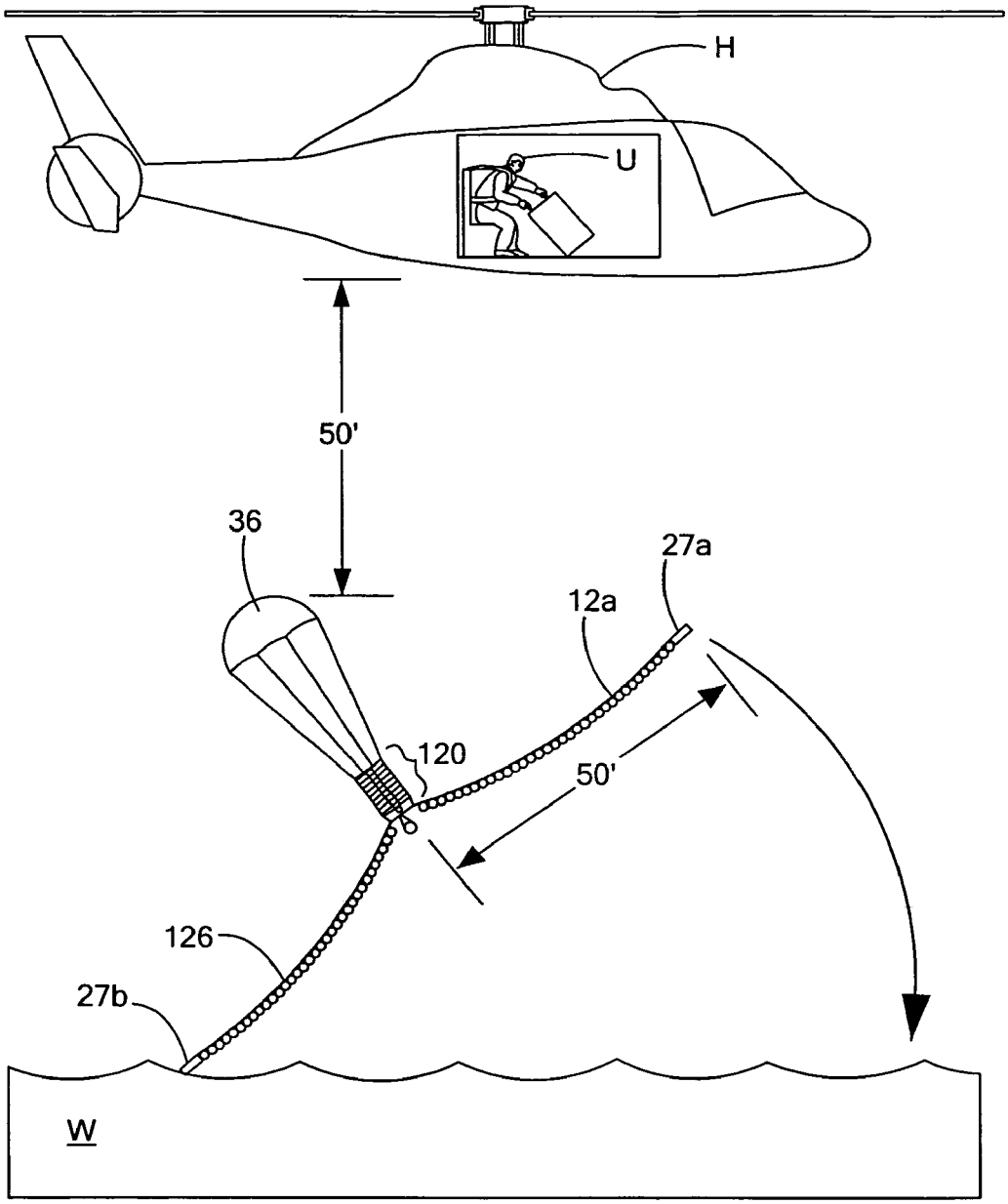

Due to the mass properties and shape of the package, a stabilizer such as parachute 36, FIG. 16D is useful to properly orient the package as it falls. The stabilizer design is typically a small auto-inflating drogue packaged in a bag tethered to the launch tube to allow the munition to separate from the aircraft before the stabilizer deploys. Preliminary stabilization verification tests following launch tube delivery from a commercial helicopter were completed.

The watercraft arresting system of the subject invention is thus simple in design, easy to use, and relatively inexpensive when compared to prior resting systems. Watercraft of all sizes and configurations can be reliably stopped or slowed down.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A watercraft arresting system comprising:

an entanglement subsystem including at least two arms;

a deployment subsystem for deploying the entanglement subsystem so the arms are spread apart in the water in the path of the watercraft, the deployment subsystem including a launch tube housing a carrier for the arms, a parachute attached to the carrier, and a discharge assembly for spreading the arms;

means for releasing the carrier, the parachute, and the discharge assembly from the launch tube;

means for deploying the parachute; and means for activating the discharge assembly after the parachute is deployed.

2. The system of claim 1 in which the discharge assembly includes a barrel housing a plug attached to each arm.

3. The system of claim 2 in which there is a charge in each barrel behind the plug.

4. The system of claim 3 in which the means for activating the discharge assembly includes a fuse assembly for firing the charges and a firing pin for igniting the fuse assembly.

5. The system of claim 4 in which the fuse assembly includes a primer charge set off by the firing pin, a delay fuse lit by the primer charge, and fuse links each extending between the delay fuse and a plug charge and lit by the delay fuse.

6. The system of claim 5 in which the means for releasing the carrier includes a launch tube top plate including at least one clamp releasably holding the carrier in the launch tube, the means for deploying the parachute includes a tether extending between the top plate and the parachute, and the means for activating the discharge assembly includes a tether line which pulls the firing pin.

7. The system of claim 6 in which the tether line which pulls the firing pin is shorter than the tether extending between the top plate and the parachute.

8. A method of arresting a watercraft vessel, the method comprising:

packaging an entanglement subsystem on a carrier attached to a parachute and a deployment subsystem all in a launch tube;

releasing the carrier, the parachute, and the deployment subsystem from the launch tube;

deploying the parachute; and activating the deployment subsystem to deploy the entanglement subsystem in the water in the path of the vessel.

9. The method of claim 8 in which the entanglement subsystem includes at least two arms in a V-configuration.

10. The method of claim 9 in which the entanglement subsystem includes two additional arms also in a V-configuration forming an X-configuration with the first two arms.

11. The method of claim 9 in which the entanglement subsystem includes three arms in a Y-configuration.

12. The method of claim 9 in which the entanglement subsystem includes multiple arms in a star-configuration.

13. The method of claim 9 in which the entanglement subsystem includes a third arm connected to the two arms in a triangle configuration.

14. The method of claim 9 in which the arms are made of netting.

15. The method of claim 9 in which the arms are made of sheet material.

16. The method of claim 9 in which the arms are made of rope material.

17. The method of claim 9 in which the entanglement subsystem includes at least four arms made of net material, each connected to a head line.

18. The method of claim 17 further including a perimeter line connected to ends of the head lines.

19. The method of claim 18 in which the netting material for each arm is longer than an arm, bunched up, and slideably attached to a head line.

20. The method of claim 18 in which the head lines are slideably attached to the perimeter line.

21. The method of claim 17 in which each arm is connected to a foot line opposite the head line.

22. The method of claim 21 in which each foot line is weighted.

23. The method of claim 17 in which the netting material is made of SPECTRA and is constructed in a knotless weave.

24. A watercraft arresting system comprising:

an entanglement system including arms made of net material, each arm connected to a headline, the netting material for each arm longer than the arm, bunched up, and slideably attached to a headline; and a deployment subsystem including a carrier for the arms, a parachute attached to the carrier, and a discharge assembly for spreading the arms for deploying the entanglement subsystem so that the arms are spread apart in the water in the path of the watercraft.

25. The system of claim 24 further including a perimeter line connected to ends of the headlines.

26. A watercraft arresting system comprising:

an entanglement subsystem including at least two arms; and a deployment subsystem including a carrier for the arms, a parachute attached to the carrier, and a discharge assembly for spreading the arms, the carrier, parachute, and the discharge assembly packaged in a launch tube for deploying the entanglement subsystem so that the arms are spread apart in the water in the path of the watercraft.

27. The system of claim 26 further including a safety pin releasably locking the carrier in the launch tube.

* * * * *